US006357475B1

(12) United States Patent
Geiser

(10) Patent No.: US 6,357,475 B1
(45) Date of Patent: Mar. 19, 2002

(54) PNEUMATIC SEQUENTIAL CONTROL VALVE

(75) Inventor: Friedrich Geiser, Nueziders (AT)

(73) Assignee: VAT Holding AG, Haag (CH)

( * ) Notice: Subject to any disclaimer, the term of this patent is extended or adjusted under 35 U.S.C. 154(b) by 0 days.

(21) Appl. No.: 09/759,099

(22) Filed: Jan. 11, 2001

(51) Int. Cl.[7] ..... F15B 13/07
(52) U.S. Cl. ..... 137/596; 91/6; 91/36; 91/38
(58) Field of Search ..... 91/6, 36, 38; 137/596

(56) References Cited

U.S. PATENT DOCUMENTS 3,896,852 A * 7/1975 Holmes ..... 91/38 X

* cited by examiner

*Primary Examiner*—Gerald A. Michalsky
(74) *Attorney, Agent, or Firm*—Reed Smith LLP

(57) ABSTRACT

A pneumatic sequential control valve for successive aeration and deaeration of two consumers, wherein for purposes of aeration compressed air is initially applied to the first consumer and only subsequently to the second consumer, and for deaeration the compressed air is initially let off from the second consumer and only subsequently from the first consumer, comprises a valve body with connections for a compressed air line and a first consumer and second consumer, wherein a cavity is provided in the valve body, bore holes extend from the connections for the consumers and for the compressed air line to this cavity. A control slide is mounted in this cavity so as to be displaceable, wherein a control space is provided between an end side of the control slide, at which a piston surface is arranged, and the valve body, and this control space communicates, via a choke line, with the bore hole which is connected with the connection for the compressed air line, and the control slide is pretensioned in direction of its first end position by means of a spring arrangement.

8 Claims, 1 Drawing Sheet

Fig. 1
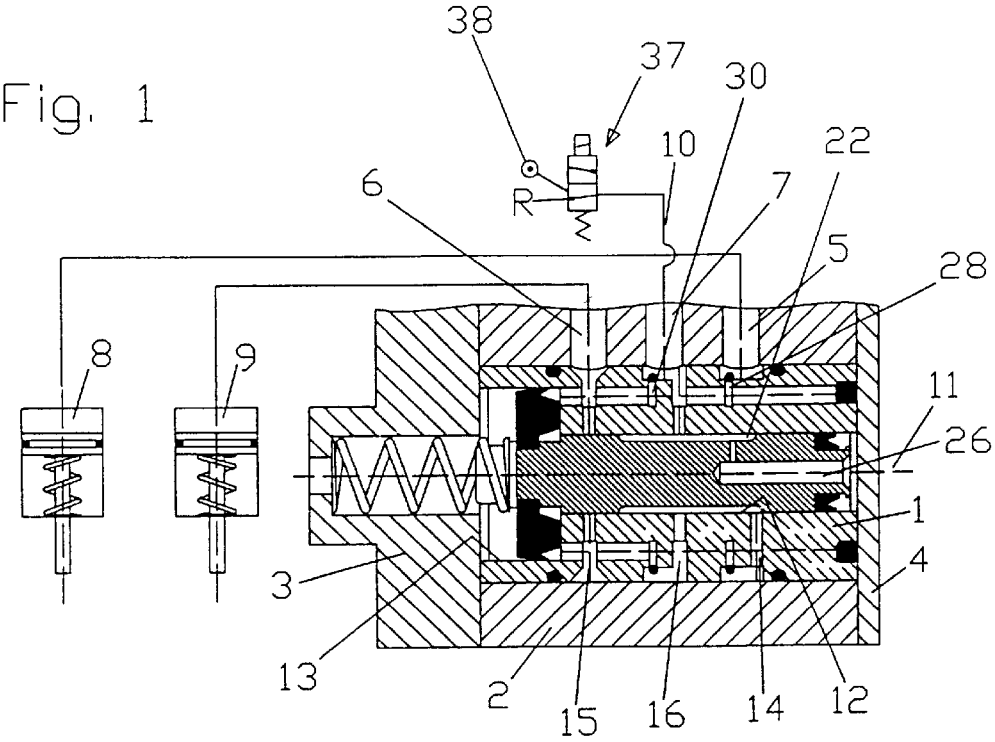
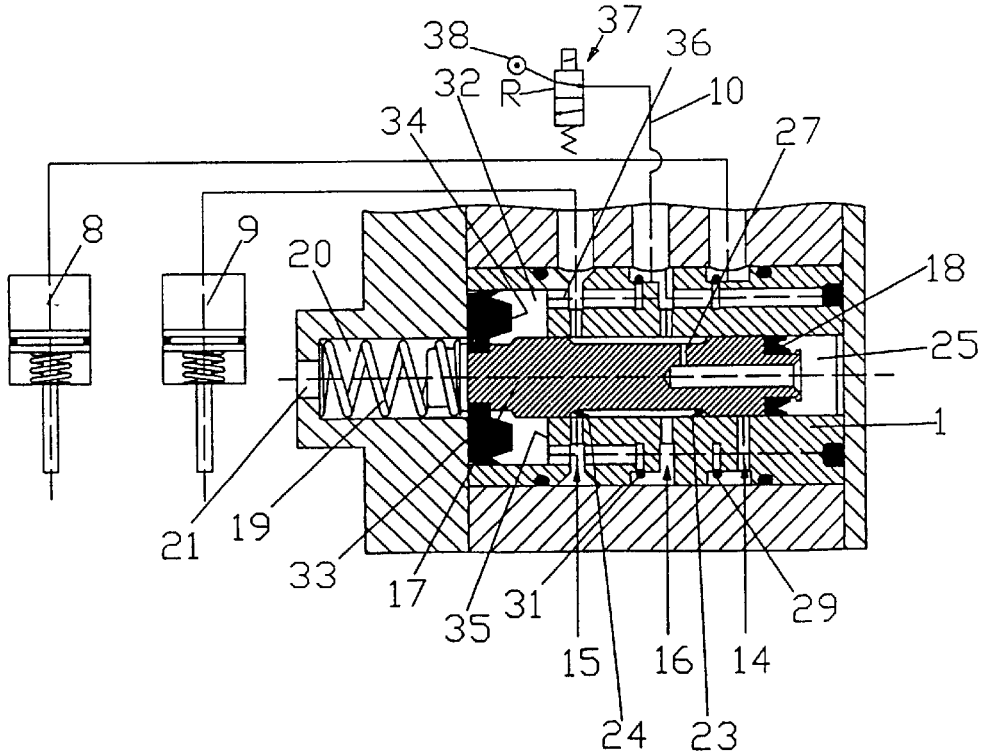
Fig. 2

PNEUMATIC SEQUENTIAL CONTROL VALVE

BACKGROUND OF THE INVENTION a) Field of the Invention

The invention is directed to a pneumatic sequential control valve for successive aeration and deaeration of two consumers, wherein for purposes of aeration compressed air is initially applied to the first consumer and only subsequently to the second consumer, and for deaeration the compressed air is initially let off from the second consumer and only subsequently from the first consumer. The invention is directed especially to a pneumatic sequential control valve with a valve body in which a cavity is provided which has a longitudinal axis and a control slide which is mounted so as to be displaceable in this cavity in direction of the longitudinal axis of the cavity.

b) Description of the Related Art

Valves with a valve body and a control slide which is displaceably mounted therein have been known for a long time. Further, various embodiment forms of pneumatic sequential control valves for successive aeration and deaeration of two consumers are known, for example, also with a control slide which is mounted in a valve body so as to be displaceable. The known pneumatic sequential control valves are generally relatively complicated constructions and are relatively highly susceptible to problems, so that it is no longer ensured, for example, that the consumers will be controlled in correct sequence.

OBJECT AND SUMMARY OF THE INVENTION

It is the primary object of the invention to provide a pneumatic sequential control valve which is simple to produce. A further object of the invention is to provide a pneumatic sequential control valve which requires little effort to install in a pneumatic system. A further object of the invention is to provide a pneumatic sequential control valve which has a compact construction but nevertheless allows a high through-flow rate. A further object of the invention is to provide a pneumatic sequential control valve which has the longest possible useful life without maintenance.

These and other objects of the invention which follow from the description are met by a pneumatic sequential control valve according to the invention. A sequential control valve of the type mentioned above according to the invention has the following features:

A valve body with connections for a compressed air line, for a first consumer and for a second consumer, wherein a cavity having a longitudinal axis is provided in the valve body, and a first bore hole extends from the connection for the first consumer to this cavity; further a second bore hole extends from the connection for the second consumer to this cavity; and further a third bore hole extends from the connection for the compressed air line to this cavity; a control slide which is mounted in this cavity so as to be displaceable in direction of the longitudinal axis of the cavity and which has a first end side and a second end side and is displaceable in the first end position and second end position. Said first bore hole and said third bore hole communicate with each other in the first end position of the control slide, and said second bore hole and said third bore hole communicate with each other in the second end position of the control slide. A control space is provided between the first end side of the control slide, at which a piston surface is provided, and the valve body, the volume of the control space being at a minimum in the first end position of the control slide and at a maximum in the second end position of the control slide. This control space communicates with the third bore hole via a choke line. The control slide is biased or pretensioned in direction of its first end position by means of a spring arrangement.

A pneumatic sequential control valve of the type mentioned above can be produced relatively easily. This sequential control valve can make do without direct position-reporting sensors and without additional pressure sensors, so that complicated assembly work can be avoided when installing in the pneumatic system. This sequential control valve can be constructed in such a way that it has a high through-flow in spite of its compact construction, so that a plurality of first and second consumers can also be controlled simultaneously. A pneumatic sequential control valve of this kind functions reliably and can have a very long useful life (for example, more than twenty million switching processes) without requiring maintenance.

With reference to a first, second and third bore hole indicated above and in the following, it is meant that there is at least one such bore hole. In a preferred embodiment example, there are a plurality of such bore holes which are offset relative to one another in circumferential direction to maximize the through-flow of the sequential control valve.

In a preferred embodiment form of the invention, a line is provided in the valve body which connects the third bore hole with the first bore hole and in which a check valve is arranged which closes when the pressure in the first bore hole exceeds the pressure in the third bore hole. By means of this line, pressure is applied to the first consumer when compressed air is applied to the compressed air line even in the second setting of the control slide. Such application of pressure to the first consumer would otherwise have to be carried out in a different manner in order to compensate for pressure losses in the aerated state of the first consumer, for example, by means of an additional switching valve as will be explained in more detail in the description of the drawings.

In a preferred embodiment form of the invention, a line is provided which connects the third bore hole to the second bore hole and in which is arranged a check valve which closes when the pressure in the third bore hole exceeds the pressure in the second bore hole. Without a line of this kind, complete deaeration of the second consumer in the pressureless state of the compressed air line, should such complete deaeration be required, would have to be carried out in a different manner as will be described in more detail in the description of the drawings.

In a preferred initial form of the invention, an additional control space is provided which cooperates with another piston surface of the control slide. When pressure is applied to this additional control space, the control slide is acted upon by a force directed against the pretensioning force of the spring arrangement. A connection line is provided between the additional control space and the second bore hole. This additional control space serves for increased protection against an unwanted change in the state of the control valve in case of a reduction in the system pressure as will follow more clearly in the description of the drawings.

Other advantages and details of the invention are described in the following with reference to the embodiment example shown in the drawing, further objectives of the invention following from this.

BRIEF DESCRIPTION OF THE DRAWINGS

In the drawings:

FIG. 1 shows a schematic section through a sequential control valve according to the invention to which consumers are connected, in the deaerated state; and FIG. 2 shows a schematic view corresponding to FIG. 1, but in the aerated state.

DESCRIPTION OF THE PREFERRED EMBODIMENTS

The sequential control valve comprises a valve body which is formed by an insert part 1 which is arranged in a valve housing 2 with a cover 3 and a base 4. The valve body has connections (not shown in detail in the Figures) 5, 6, 7 for a first consumer 8, for a second consumer 9 and for a compressed air line 10. A cavity having a longitudinal axis 11 is provided in the valve body. This cavity comprises a first cylindrical portion 12 and a second cylindrical portion 13 with a larger diameter compared with the first portion. First, second and third bore holes 14, 15, 16 extend at right angles to the longitudinal axis 11 from the connections 5, 6, 7 for the first consumer 8, the second consumer 9 and the compressed air line 10 to the portion 12 of the cavity in the valve body, wherein they are spaced apart in direction of the longitudinal axis 11 and wherein the third bore hole which communicates with the compressed air line is located between the first bore hole and the second bore hole.

A control slide 17 is mounted in the cavity in the valve body so as to be displaceable in direction of the longitudinal axis 11 of the cavity. The control slide is displaceable between the first end position shown in FIG. 1 and the second end position shown in FIG. 2. The control slide 17 has first and second end sides. The first end side located on the right in the Figures forms a piston surface 18. A spring 19 which pretensions the control slide 17 in its first end position acts at the second end side and is supported by its other end at the base of a pocket bore hole 20 in the inner side of the cover 3, this pocket bore hole 20 communicating with the atmosphere via a bore hole 21. Instead of the spring 19 shown here, another spring arrangement could also be provided for acting upon the piston in the direction of its first end position.

The control slide 17 has a recess 22 at its outside surface. This recess 22 is formed by an annular groove in the outer surface of the control slide 17, which annular groove forms control edges 23, 24 at both of its axial ends. In the first end position shown in FIG. 1, the first bore hole 14 and the third bore hole 16 are connected with one another by this recess 22 which forms a line or channel. In the second end position of the control slide shown in FIG. 2, the second bore hole 15 and the third bore hole 16 are connected with one another via the recess 22.

A control space 25, whose volume is at a minimum in the first end position of the control slide 17 shown in FIG. 1 and at a maximum in the second end position of the control slide shown in FIG. 2, is formed between the first end side of the control slide 17 or piston surface 18 provided at this first end side and the base 4. This control space 25 communicates with the third bore hole 16 in every position of the control slide 17. For this purpose, a pocket bore hole 26 is arranged in the first end side of the control slide 17. The choke line 27 extends between this pocket bore hole 26 and the recess 22 in the outside surface of the control slide 17.

Further, a line 28 is formed in the valve body, which line 28 connects the third bore hole 16 with the first bore hole 14 and in which a check valve 29 is arranged which closes when the pressure in the first bore hole exceeds the pressure in the third bore hole 16. This check valve 29 is formed by an O-ring which is arranged in an annular groove with a V-shaped cross section, wherein a bore hole forming part of the line 28 proceeds from the base of this groove.

Further, a line 30 is provided which connects the third bore hole 16 with the second bore hole 15 and in which is arranged a check valve 31 which closes when a pressure in the third bore hole exceeds the pressure in the second bore hole. This check valve 31 is constructed analogous to check valve 29.

Another control space 32 is provided in the cavity of the valve body, namely, in its second cylindrical portion 13. A portion 33 forming a piston is provided at the control slide. The control space 32 lies between the piston surface 34 of this piston and a part 35 of the wall of the cavity oriented at right angles to the longitudinal axis 11 of the cavity, wherein when pressure is applied to this other control space 32, the control slide 17 is acted upon by a force directed against the pretensioning force of the spring 19. A connection line 36 is formed between the other control space 32 and the second bore hole 15.

A reversing valve 37 through which the compressed air line can either be acted upon by compressed air or connected to atmospheric pressure is connected to the compressed air line 10. A suitable pressure source 38 is provided for applying compressed air to the compressed air line 10. In the position of the reversing valve shown in FIG. 1, the compressed air line 10 is connected to atmospheric pressure. In the position of the reversing valve 37 shown in FIG. 2, the compressed air line 10 is connected to the pressure source 38.

The operation of the pneumatic sequential control valve will be explained in the following.

When the reversing valve 37 is switched starting from the switching state shown in FIG. 1 and compressed air is applied to the compressed air line, the compressed air flows along the recess 22 of the control slide 17 via the first bore hole 14 to connection 5 and further to the first consumer 8 which is shown here as a cylinder. At the same time, compressed air can also flow via line 23 and valve 29 to the connection 5. Compressed air flows further through the choke line 27 into the control space 25. The pressure building up in the control space 25 acts on the control slide 17 via the piston surface 18 and begins to press the control slide 17 against the force of the spring 19 from its first end position in the direction of its second end position shown in FIG. 2. After the control edge 23 of the control slide 17 has closed the bore hole 14, compressed air can flow via the line 28 and check valve 29 to the consumer 8 and can continue to fill the latter. At a determined pressure value in the control space 25, for example, 3.6 bar, the control edge 24 releases the second bore hole 15 at the control slide 17.

Compressed air can accordingly also flow through the bore hole 15 into the second consumer 9. At the same time, the control space 32 and accordingly the piston surface 34 are acted upon by compressed air through connection line 36. Due to this abrupt enlargement of the effective piston surface, the control slide 17 is suddenly displaced toward the left to the stop, that is, into its second end position shown in FIG. 2. The bore hole 15 is accordingly completely released. The aeration process is terminated when the system pressure applied to the compressed air line 10 is present in both consumers.

For deaeration, the reversing valve is switched from its state shown in FIG. 2 into the position shown in FIG. 1 in which the compressed air line is connected with the reservoir R, that is, with atmospheric pressure. Compressed air flows from the second consumer 9 initially via the second bore hole 15 and the recess 22 at the control slide 17 to the third bore hole 16 and to the compressed air line 10. At the same time, compressed air can also flow from the second consumer 9 through the line 30 and the check valve 31 to line 10. Further, compressed air stored in the control space 25 flows through the choke line 27 and the recess 22 to the third bore hole 16 and further to the pressureless compressed air line 10. The pressure acting on the piston surfaces 34 and 18 is accordingly reduced. The pressure in the control space 25 is reduced somewhat more slowly due to the choke line 27. For the present, no pressure can escape from the first consumer 8. When the pressure in the first control space falls below a certain value (for example, approximately 1 bar), the control slide 17 starts to move toward the right, that is, in the direction of its first end position shown in FIG. 1, as a result of the force of the spring 19. After the control edge 24 has closed the second bore hole 15, compressed air now flows out of the second consumer 9 only via line 30 and check valve 31 to the compressed air line 10. The control slide 17 moves further to the right to the control edge 23, corresponding to the decreasing pressure, until the control edge 23 releases the first bore hole 14. Consequently, the first consumer 8 is also deaerated in that the compressed air flows via the first bore hole 14 and the recess 22 in the control slide 17 to the third bore hole 16 and further to the compressed air line 10.

The described switching functions are ensured within a certain pressure range of the input pressure or system pressure, for example, between 4 and 7 bar, and an outgoing air pressure (impact pressure) which does not exceed a determined limiting value, for example, 0.5 bar. When the system pressure is too low, switching to the second consumer is no longer carried out. An excessive impact pressure in the outgoing air line would prevent switching from the second consumer to the first consumer during the deaeration process.

The switching speed, that is, the interval in time between aeration of the first consumer and of the second consumer or deaeration of the first consumer and of the second consume, can be changed optionally by changing the volume of the control space 25 or changing the cross section of the choke bore hole 27 (from a few seconds to minutes). The degree of input pressure or system pressure has a rather small influence on the time response of switching.

Instead of the recess 22, lines could also be arranged inside the control slide 17 through which the connections are achieved in the described manner. Instead of forming the choke line 27 in the control slide 17, this choke line could also be arranged in the valve body and connected with the control space 25 on the one hand and the connection 7 or choke line 10 on the other hand.

In a simplified embodiment form of the sequential control valve, one of the two lines 28, 30 or both lines together with the associated check valve 29, 31 could be dispensed with. Without line 28, the application of full pressure to the first consumer would have to be terminated already when the control edge 23 has closed the first bore hole 14. Further, the first consumer 8 would not be acted upon in the aerated state (corresponding to FIG. 2) in order to compensate for pressure loss. Instead of line 28, the reversing valve 37 could also be coupled with another switching valve which is connected with the first consumer 8 via a connection line and which applies compressed air to the first consumer 8 in the aerated state (corresponding to FIG. 2) and closes the connection line to the first consumer 8 in the deaerated state (corresponding to FIG. 1), this switching valve being connected to this connection line.

Without line 30, only an incomplete deaeration of the second consumer 9 takes place. Instead of line 30, another switching valve which is connected to a line connected to the second consumer 9 could also be coupled with the reversing valve 37. This line connected to the second consumer 9 would be connected to atmospheric pressure by this additional switching valve in the deaerated state (corresponding to FIG. 1) and would be closed by the additional switching valve in the aerated state (corresponding to FIG. 2).

In another simplified embodiment form of the invention, the control space 32 and the associated piston formed of portion 33 could also be omitted. This would limit the reliability of the sequential control valve with respect to reduced system pressure, that is, proper use of the sequential control valve would only be possible within a limited range of the system pressure.

While the foregoing description and drawings represent the present invention, it will be obvious to those skilled in the art that various changes may be made therein without departing from the true spirit and scope of the present invention.

Reference Number

1 insert part
2 valve housing
3 cover
4 base
5 connection
6 connection
7 connection
8 first consumer
9 second consumer
10 compressed air line
11 longitudinal axis
12 portion
13 portion
14 first bore hole
15 second bore hole
16 third bore hole
17 control slide
18 piston surface
19 spring
20 pocket bore hole
21 bore hole
22 recess
23 control edge
24 control edge
25 control space
26 pocket bore hole
27 choke line
28 line
29 check valve
30 line
31 check valve
32 control space
33 portion
34 piston surface

35 part

36 connection line

37 reversing valve

38 pressure source

What is claimed is:

1. A pneumatic sequential control valve for successive aeration and deaeration of two consumers, wherein for purposes of aeration compressed air is initially applied to the first consumer and only subsequently to the second consumer, and for deaeration the compressed air is initially let off from the second consumer and only subsequently from the first consumer, which sequential control valve comprises:

a valve body with connections for a compressed air line and a first consumer and second consumer, wherein a cavity having a longitudinal axis is provided in the valve body, and a first bore hole extends from the connection for the first consumer to this cavity; further a second bore hole extends from the connection for the second consumer to this cavity; and further a third bore hole extends from the connection for the compressed air line to this cavity;

a control slide which is mounted in this cavity so as to be displaceable in a direction of the longitudinal axis of the cavity and which has a first end side and a second end side and is displaceable to a first end position and to a second end position;

said first bore hole and said third bore hole communicating with each other in the first end position of the control slide, and the second bore hole and the third bore hole communicating with each other in the second end position of the control slide;

a control space being provided between the first end side of the control slide, at which a piston surface is arranged, and the valve body, the volume of the control space being at a minimum in the first end position of the control slide and at a maximum in the second end position of the control slide;

the control space communicating with the third bore hole via a choke line; and said control slide being pretensioned in direction of a first end position by means of a spring arrangement.

2. The pneumatic sequential control valve according to claim 1, wherein the control slide has a recess at its outside surface forming a line for connecting the first bore hole and the third bore hole in said first end position of the control slide and for connecting the second bore hole and the third bore hole in the second end position of the control slide.

3. The pneumatic sequential control valve according to claim 2, wherein a line is provided in the control slide which connects the recess with the control space and which comprises the choke line.

4. The pneumatic sequential control valve according to claim 1, wherein a line is provided which connects the third bore hole with the first bore hole and in which a check valve is arranged which closes when the pressure in the first bore hole exceeds the pressure in the third bore hole.

5. The pneumatic sequential control valve according to claim 1, wherein a line is provided which connects the third bore hole to the second bore hole and in which is arranged a check valve which closes when the pressure in the third bore hole exceeds the pressure in the second bore hole.

6. The pneumatic sequential control valve according to claim 1, wherein an additional control space is provided between a piston surface of the control slide, which piston surface is formed by a portion of the control slide with an increased diameter, and a portion of the wall of the cavity oriented at right angles to the longitudinal axis of the cavity, wherein, when pressure is applied to this additional control space, the control slide is acted upon by a force directed against the pretensioning force of the spring arrangement, and a connection line is provided between the additional control space and the second bore hole.

7. The pneumatic sequential control valve according to claim 6, wherein the cavity in the valve body in which the control slide is mounted in a displaceable manner and has a first cylindrical portion and a second cylindrical portion with a larger diameter compared with the first portion, wherein the area of the control slide which adjoins the second end side projects into the second portion, wherein the control slide has, in the portion of the cavity with increased diameter, a cylindrical portion with an increased diameter which forms a piston and at which the additional piston surface is provided.

8. The pneumatic sequential control valve according to claim 1, wherein the third connection for the compressed air line is connected with a reversing valve via this compressed air line, through which reversing valve the compressed air line can either be acted upon by compressed air or can be connected to atmospheric pressure.

* * * * *